US010694879B2

(12) United States Patent
Wach

(10) Patent No.: US 10,694,879 B2
(45) Date of Patent: Jun. 30, 2020

(54) CHRISTMAS TREE STAND

(71) Applicant: Ryan Robert Wach, Valencia, CA (US)

(72) Inventor: Ryan Robert Wach, Valencia, CA (US)

( * ) Notice: Subject to any disclaimer, the term of this patent is extended or adjusted under 35 U.S.C. 154(b) by 278 days.

(21) Appl. No.: 15/727,350

(22) Filed: Oct. 6, 2017

(65) Prior Publication Data

US 2018/0110353 A1 Apr. 26, 2018

Related U.S. Application Data

(60) Provisional application No. 62/496,661, filed on Oct. 25, 2016.

(51) Int. Cl.
*A47G 33/12* (2006.01)

(52) U.S. Cl.
CPC ..... *A47G 33/1226* (2013.01); *A47G 33/1206* (2013.01); *A47G 2033/124* (2013.01); *A47G 2033/1286* (2013.01)

(58) Field of Classification Search
CPC ..... A47G 33/1226; A47G 33/1206; A47G 2033/1286; A47G 2033/1293
USPC ..... 47/40.5, 79, 65.5; 248/523, 524
See application file for complete search history.

(56) References Cited

U.S. PATENT DOCUMENTS 2,245,316 A * 6/1941 Amsler ..... G01N 3/04 73/859
4,119,290 A * 10/1978 Gies ..... A47G 33/12 248/523
5,464,186 A * 11/1995 Robert ..... A47G 33/12 248/524
6,129,325 A * 10/2000 Niklas ..... A47G 33/12 248/516
D443,227 S * 6/2001 Sofy ..... D11/130.1
D444,412 S * 7/2001 Krinner ..... A47G 33/1213 D11/130.1
7,341,234 B2 * 3/2008 Kowalski ..... A47G 33/1213 248/523
7,484,703 B2 * 2/2009 Krinner ..... A47G 33/1213 248/519
7,484,704 B2 * 2/2009 Schommertz ..... A47G 33/1213 248/523
7,618,022 B2 * 11/2009 Thurner ..... A47G 33/1213 254/223
9,723,941 B2 * 8/2017 Finnin, Jr. ..... A47G 33/1206
D846,430 S * 4/2019 Wach ..... D11/130.1
(Continued)

FOREIGN PATENT DOCUMENTS

DE 2156712 A1 5/1973
DE 19931309 A1 1/2001
(Continued)

*Primary Examiner* — Ebony E Evans
(74) *Attorney, Agent, or Firm* — Kelly & Kelley, LLP

(57) ABSTRACT

A tree stand for removably supporting a tree includes a base having a water basin. A plurality of spaced apart jaws are biased upwardly and inwardly of an axis of the base to form an expandable clamp. An end of a trunk of the tree forcibly expands the jaws against their bias as the trunk is inserted into the water basin. The jaws of the clamp engage an outer surface of the trunk as they are biased towards their closed position to hold the tree vertically upright and stable.

20 Claims, 9 Drawing Sheets

(56) References Cited

U.S. PATENT DOCUMENTS

| | | | | |
|---|---|---|---|---|
| 2003/0084607 | A1* | 5/2003 | Cone | A47G 33/1206 47/40.5 |
| 2007/0012851 | A1* | 1/2007 | Krinner | A47G 33/1213 248/524 |
| 2011/0284717 | A1* | 11/2011 | Schulz | A47G 33/1213 248/515 |
| 2016/0029827 | A1 | 2/2016 | Finnin, Jr. | |

FOREIGN PATENT DOCUMENTS

| | | | | | |
|---|---|---|---|---|---|
| DE | 102007015117 | A1 | | 8/2008 | |
| DE | 102012007454 | A1 | * | 10/2013 | A47G 33/1206 |
| GB | 1205969 | A | * | 9/1970 | E01B 9/28 |

* cited by examiner

CHRISTMAS TREE STAND

RELATED APPLICATION

This application claims the benefit of U.S. Provisional Application No. 62/496,661, filed on Oct. 25, 2016.

FIELD OF THE INVENTION

The present invention generally relates to a tree holding device. More particularly, the present invention relates to a Christmas tree stand having an expandable clamp which is opened as a Christmas tree is forcibly inserted therein, and then biased in a closed position around the tree trunk so as to hold the Christmas tree in an upright and stable position within the stand.

BACKGROUND OF THE INVENTION

It is customary in many countries which celebrate Christmas to have a Christmas tree in houses as well as commercial locations which are decorated for display as part of the Christmas holiday season. Many individuals and businesses adhere to the custom of utilizing a live evergreen Christmas tree, typically a pine tree, which is cut for this purpose. Such cut evergreen Christmas trees are often acquired through commercial Christmas tree lots and the like which offer cut Christmas trees for sale in the days and weeks preceding Christmas.

The cut Christmas tree requires a stand in order to keep it upright and stable. The stand may be as simple as fastening a small sheet of plywood or boards, typically formed in an X-configuration, to the trunk of the tree. While such stands will often maintain the Christmas tree in an upright position, due to the lack of water the cut Christmas tree will quickly dry out and wither, which is undesirable.

In an effort to maintain the tree in its green and natural appearance as long as possible, a wide variety of Christmas tree stands have been created which incorporate a basin of water in which the trunk of the Christmas tree rests. The water basin must be periodically refilled as the tree absorbs the water from the basin. Christmas tree stands are desirable for use in the temporary display of fresh Christmas trees because keeping the tree stable, upright and fresh, staying green and smelling like pine, is necessary for the desired effect of a Christmas tree.

Christmas tree stand manufacturers have conceived of several devices and methods to achieve a secure and stable base. One common method includes the use of manually adjusted screws which are connected through threaded holes of the base and arranged in a circular pattern which perpendicularly screw into the outer surface of the trunk of the tree to secure it to the base and hold it upright, such as with respect to an associated water basin of the stand. While such stands are generally inexpensive, they are difficult and inconvenient to use. The location and quantity of the screws results in the need of an iterative process and multiple people involved in order to properly install the tree as typically one person must attempt to hold the tree generally upright and vertical while at least one other individual lies on the floor and tightens the screws and periodically adjusts the screws until the Christmas tree is held in place within the stand. If this is not done properly, the tree may be imbalanced and tip over. This can also occur over time as the tree increasingly dries and the screws either lose their grip if the tree shifts, causing it to become angled from vertical or even tip over completely. The screws can also penetrate the trunk, making the tree difficult to adjust over time or be removed from the stand at the end of the season. Screws and nuts are also prone to be lost over time. Due to the location of the screws to obtain relative stability, the water reservoir is also difficult to access under the tree to check the water level and add water.

Yet another tree stand utilizes a central rod extending upwardly from the water basin. A hole is bored into a length of the tree trunk and the tree trunk is placed upon the rod, which is inserted into the bored aperture. Drawbacks associated with such Christmas tree stands is that few Christmas tree lots and retailers provide the tree boring service. The alternative is for the consumer to perform the task using power tools and uncommon drill bits, which is also inconvenient and time consuming. Furthermore, if the bored aperture is not centrally located with respect to the Christmas tree, the Christmas tree will not stand vertically upright and can tip over due to an uneven distribution of weight over the stand.

Yet another Christmas tree stand involves the use of a clamp which is manually secured to the outer surface and circumference of the base of the tree trunk. The clamp may be adjustably tightened manually, such as using a foot pedal. While this Christmas tree stand may enable the use of as few as a single person to install the Christmas tree, it is often much more expensive to purchase due to the complicated nature of the foot pedal adjusted clamping mechanism.

Accordingly, there is a continuing need for a Christmas tree stand, which is relatively inexpensive, simple in construction and use, allowing the Christmas tree to be installed quickly and easily by a single person. What is also needed is an improved Christmas tree stand that can provide a secure and stable base for a variety of tree trunk diameters, tree heights and trunk shapes. What is also needed is a tree stand where a user can easily check the water level of the water basin and conveniently add water as needed. The present invention fulfills these needs and provides other related advantages.

SUMMARY OF THE INVENTION

The present invention resides in a tree stand for removably supporting a tree, and more particularly a Christmas tree for display. The tree stand is relatively inexpensive and enables a tree to be installed quickly and easily by a single person. The tree stand also includes a water basin into which water can be conveniently added and monitored.

The tree stand generally comprises an expandable clamp associated with a water basin. The expandable clamp is biased towards a closed position. An end of a tree trunk forcibly expands the clamp against its bias as the trunk is inserted into the water basin. The clamp engages an outer surface of the tree trunk as it is biased towards a closed position, holding the tree vertically upright with respect to the water basin.

Typically, a base is associated with the water basin or defines the water basin. The base may be of a generally frustoconical configuration having a support surface engaging perimeter at a lower end thereof and defining a tree trunk receiving opening at a generally opposite end thereof. A trough may extend from the water basin outwardly a side of the base.

The clamp comprises a plurality of spaced apart jaws which are biased upwardly and inwardly of an axis of the base. At least one band, which may comprise an elastomeric material, encircles the jaws and biases the jaws towards one another. The jaws comprise a tree trunk outer surface engaging face and an angled ramp at an upper end thereof for engaging an end of the tree trunk.

The jaws are slidably coupled to the base. Each jaw comprises a leg extending therefrom that is slidably movable within a track formed in the base. The track may be formed at an angle of between 35° and 85°, and more preferably between 45° and 75°, with respect to a generally horizontal support surface of the base. The track may include a catch that is engageable with a ridge of the jaw when lateral force is applied to the jaw to prevent the jaw leg from sliding within the track.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
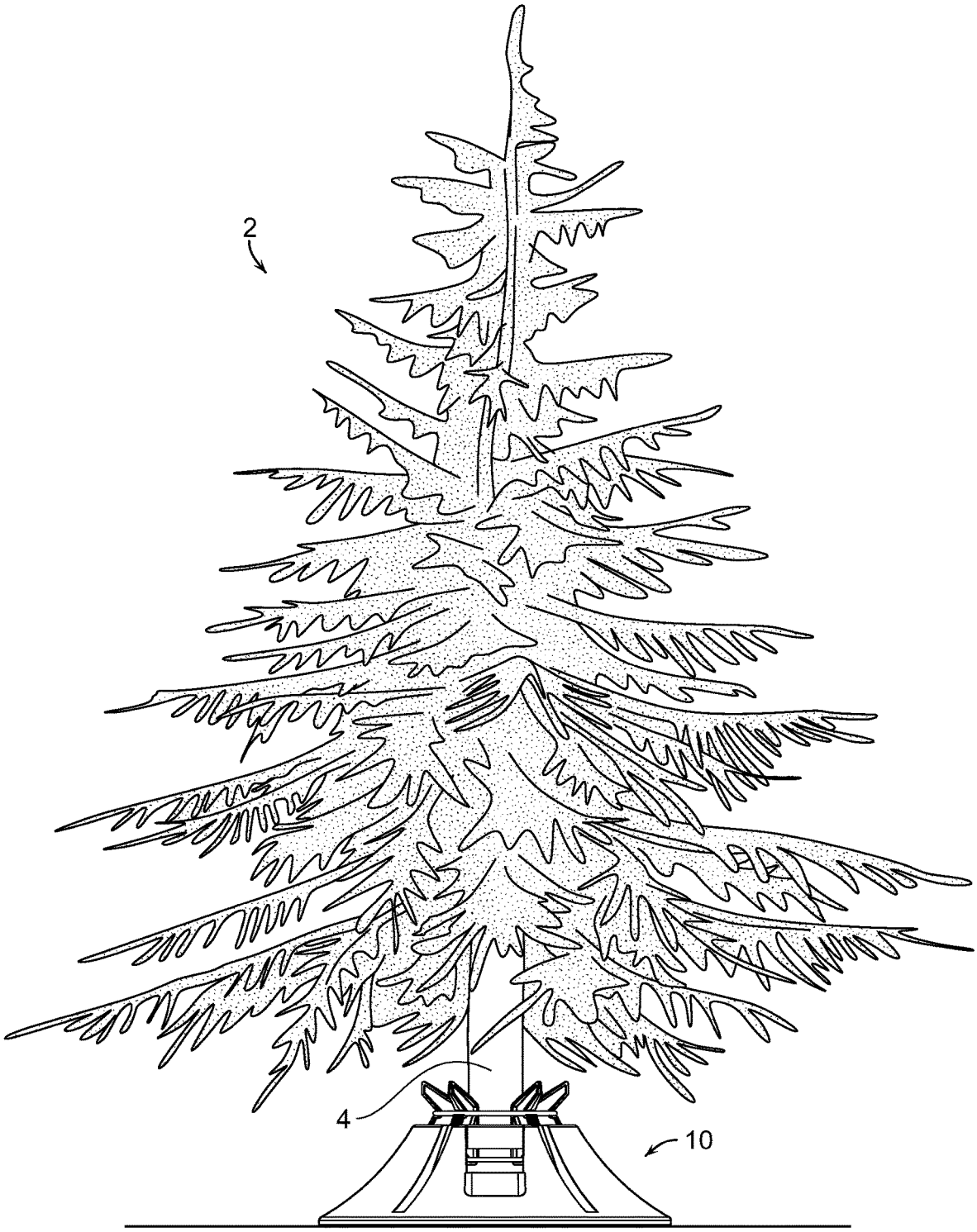
FIG. 1 is a perspective and environmental view of a tree supported in a stand embodying the present invention.

The present invention, as shown in the accompanying drawings for purposes of illustration, is directed to a tree stand, generally referred to by the reference number 10, that removably supports a tree 2, such as a cut Christmas tree or the like. The tree stand 10 of the present invention solves problems associated with common Christmas tree stands by eliminating the need for more than one person in order to properly install a Christmas tree in the stand or the need for any person installing a tree to kneel, squat or lay on the floor to assist in installing the tree. Instead, the stand 10 of the present invention is designed and configured to allow for one person to lift a tree and drop it into position with a single vertical motion, after which the tree will remain in a vertically upright and stable position, as illustrated in FIG. 1.

Figure 2:
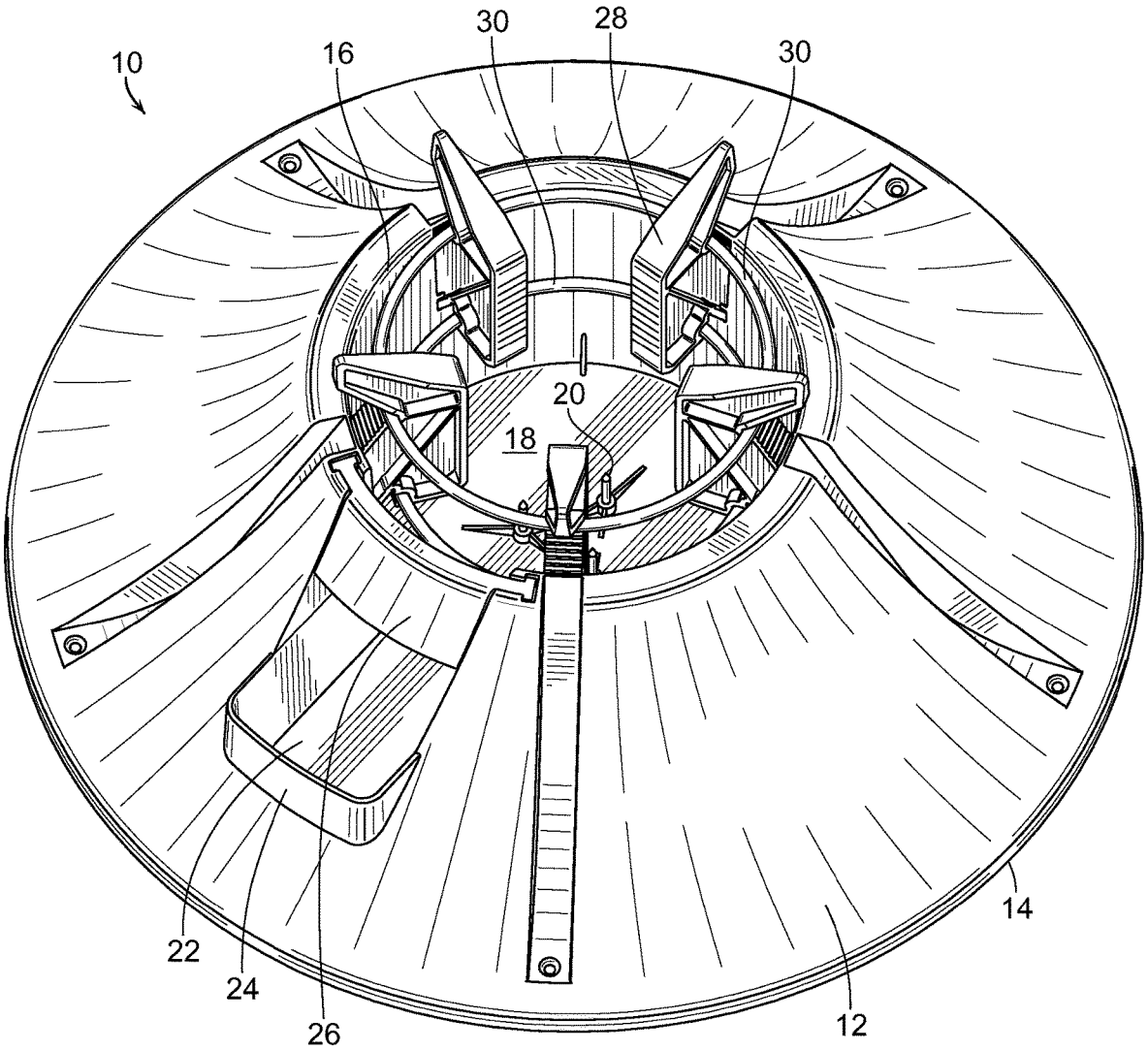
FIG. 2 is a top perspective view of a stand embodying the present invention.
Figure 3:
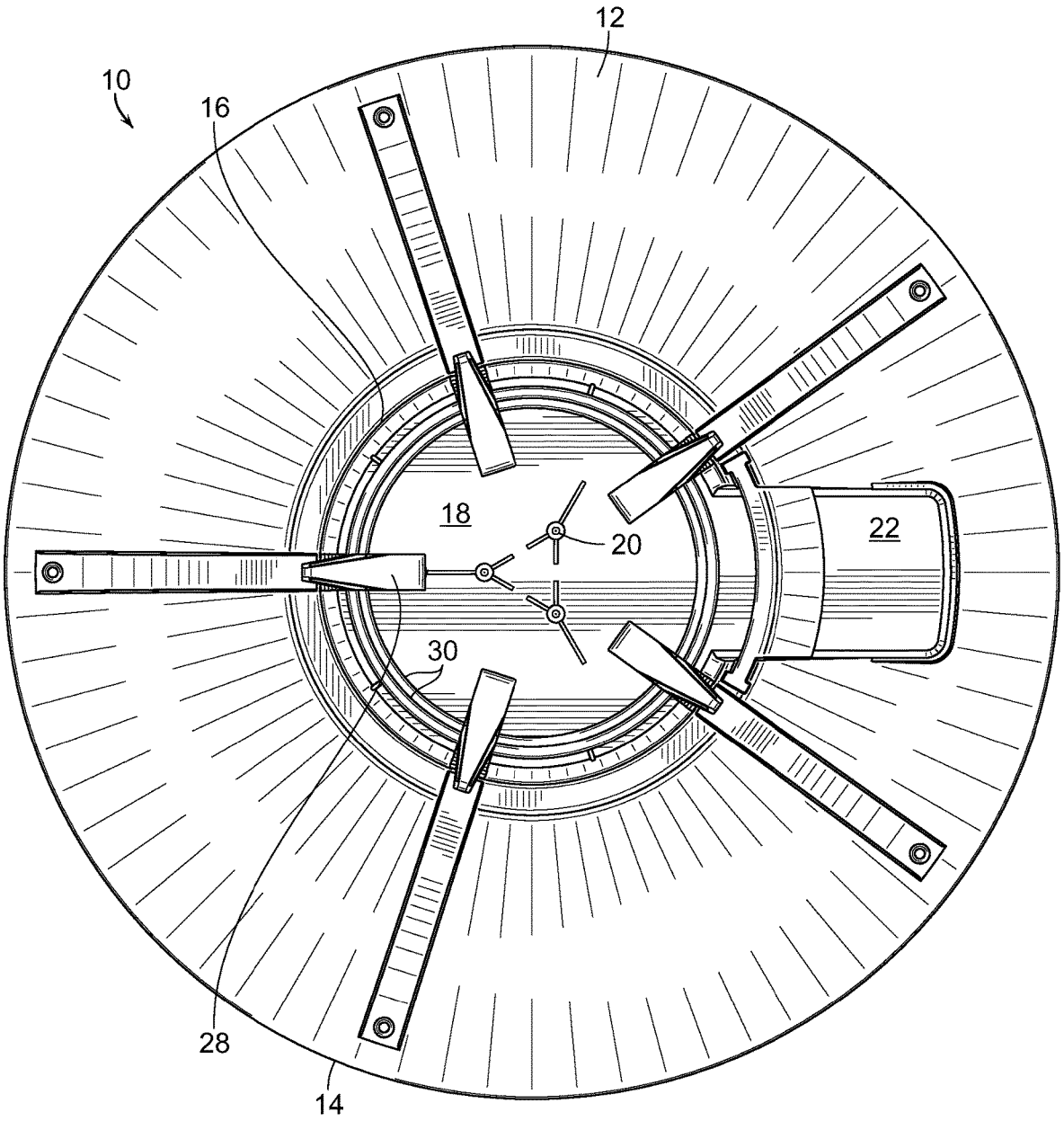
FIG. 3 is a top plan view of the stand of FIG. 2.
Figure 4:
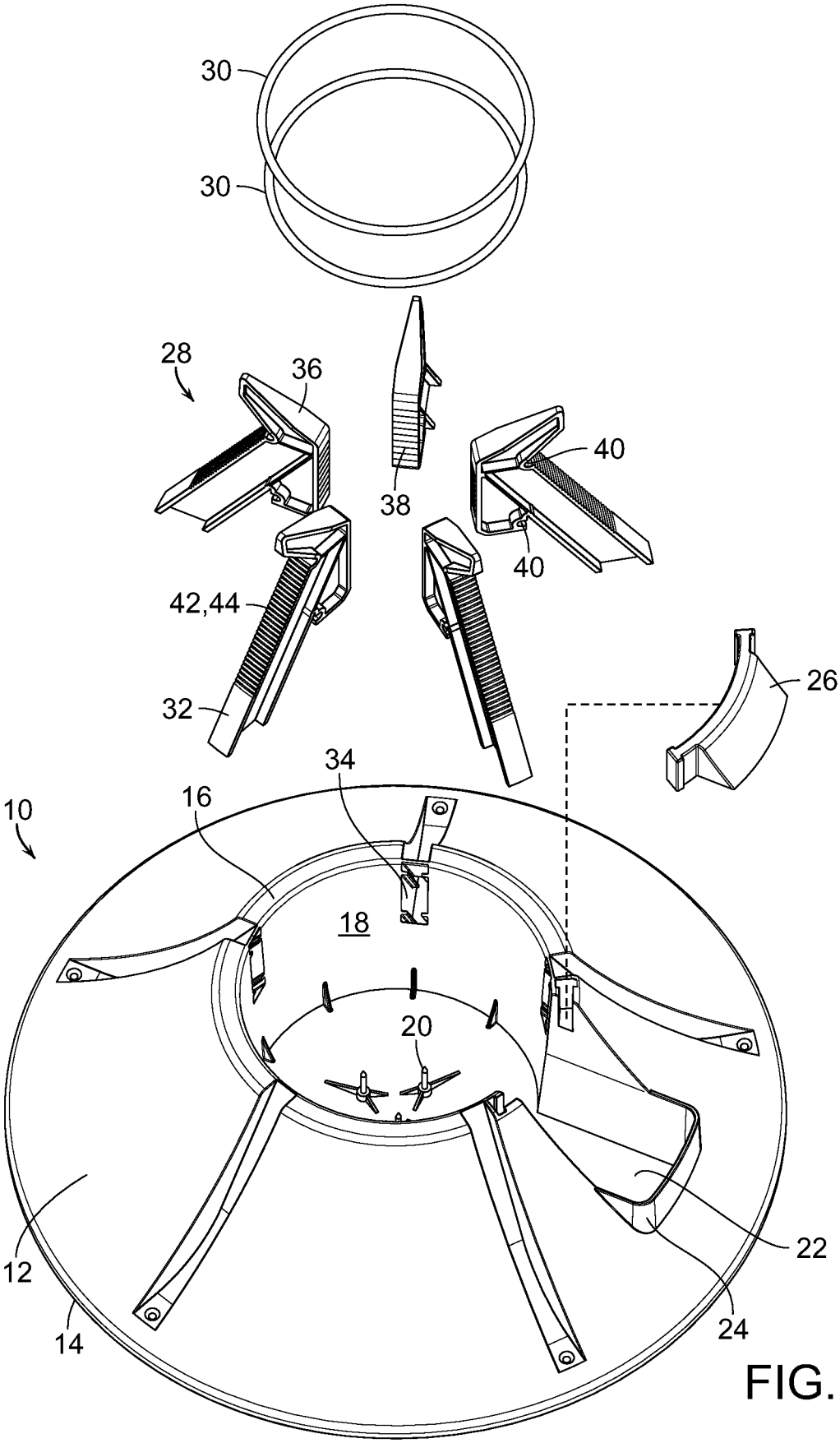
FIG. 4 is an exploded perspective view of the stand of the present invention, illustrating various component parts thereof.

With reference now to FIGS. 2-4, the tree stand 10 comprises a base 12. In the illustrated embodiment, the base 12 is a single unit, which may be molded and comprised of plastic. It will be understood, however, that the base 12 may be comprised of multiple sections or components which are attached to one another. As illustrated, the base 12 has a generally frustoconical configuration having a support surface engaging perimeter 14 at a lower end thereof which engages and rests upon a support surface, such as a floor, ground surface or the like. In the illustrated embodiment, at a generally opposite end thereof the base 12 defines a tree trunk receiving opening 16. This opening 16 is sufficiently large so as to receive a tree trunk therein as well as a clamping mechanism of the invention. The opening 16 is also typically aligned with a water basin 18, which may be integrally formed with the base 12 or associated therewith. It will be understood that the configuration of the base 12 can vary, as needed, so long as it serves the purpose of providing an adequate supporting base on a floor or other support surface so as to hold the tree 2 in an upright and stable manner. As such, the surface engaging outer perimeter 14, or those components which extend outwardly to form the base will have a minimum diameter which may be dependent upon the size of the tree to be held by the stand 10. Typically, the diameter of the base 12 will be at least one foot or more so as to adequately support the Christmas tree within the stand 10.

The water basin 18 may be integrally formed with the base 12, as illustrated, or removably associated with the base 12. The water basin 18 is sufficiently large so as to receive a trunk 4 of a tree 2 therein and hold a sufficient amount of water so as to provide water to the tree 2 over a period of time. One or more spikes 20 may extend upwardly from a base of the water basin 18. In a particularly preferred embodiment, multiple spikes 20, such as the three spaced apart spikes 20 illustrated herein, are used. The spikes 20 function to puncture a bottom surface 6 of the tree trunk 4 and inhibit the tree trunk 4 from sliding within the water basin 18. The spikes 20 essentially create a fixed point on the bottom 6 of the tree trunk 4 within the water basin 18. The spikes 20 can also serve to elevate the bottom 6 of the tree trunk 4 from the base of the water basin 18 to provide the water access to reach the bottom surface 6 of the tree trunk 4, and enable the tree 2 to absorb water.

In a particularly preferred embodiment, the water basin 18 includes a trough 22 which extends from the water basin 18 outwardly a side of the base 12. In the past, determining the water level in the water basin of prior art tree stands and replenishing and adding more water to replenish the water within the water basin has been difficult. An individual would typically be required to get down on his or her knees and insert his or her fingers into the water basin to feel the level of the water and/or utilize a flashlight to see the water level within the basin. There is typically not a lot of clearance between the tree trunk and the edge of the water basin, and thus adding water to the basin often resulted in spills.

However, use of the trough 22 of the present invention enables a user to quickly and easily determine the water level within the basin as the trough 22 extends outwardly from the water basin so as to be viewable from a side of the base 12. Furthermore, water can be added to the water basin 18 by pouring the water directly into the opening of the trough 22 as the trough 22 is in fluid communication with the water basin 18. The trough 22 may be comprised of a closed-end wall 24 which may have a generally U-shape or the like so as to extend outwardly from the base 12 and yet be in fluid communication with the water basin 18. The trough 22 may be integrally formed with the water basin 18, or integrally formed as part of molding and forming the base 12 when the water basin 18 is formed therewith as a single unit. A cover member 26 may be inserted into the base 12 above the trough 22. The cover 26 is primarily an aesthetic piece to complete the look of the base 12, but must be created as a separate piece attachable to the base 12 when the base 12 and water basin 18 are formed as a single unit, such as when the base 12 is injection molded or the like. The trough 22 is open at a top surface thereof so as to enable one to easily view the level of the water in the basin 18 and add water to the trough 22 as deemed necessary.

The stand 10 of the present invention includes an expandable clamp associated with the water basin 18 and/or base 12. The clamp is biased towards a closed position, but an end of the tree trunk 4 of a tree forcibly expands the clamp against its bias as the trunk is inserted into the water basin 18. The clamp engages an outer surface 8 of the circumference of the trunk 4 as it is biased towards a closed position, as illustrated in FIG. 7, to hold the tree 2 upright with respect to the water basin 18 and base 12.

Figure 5:
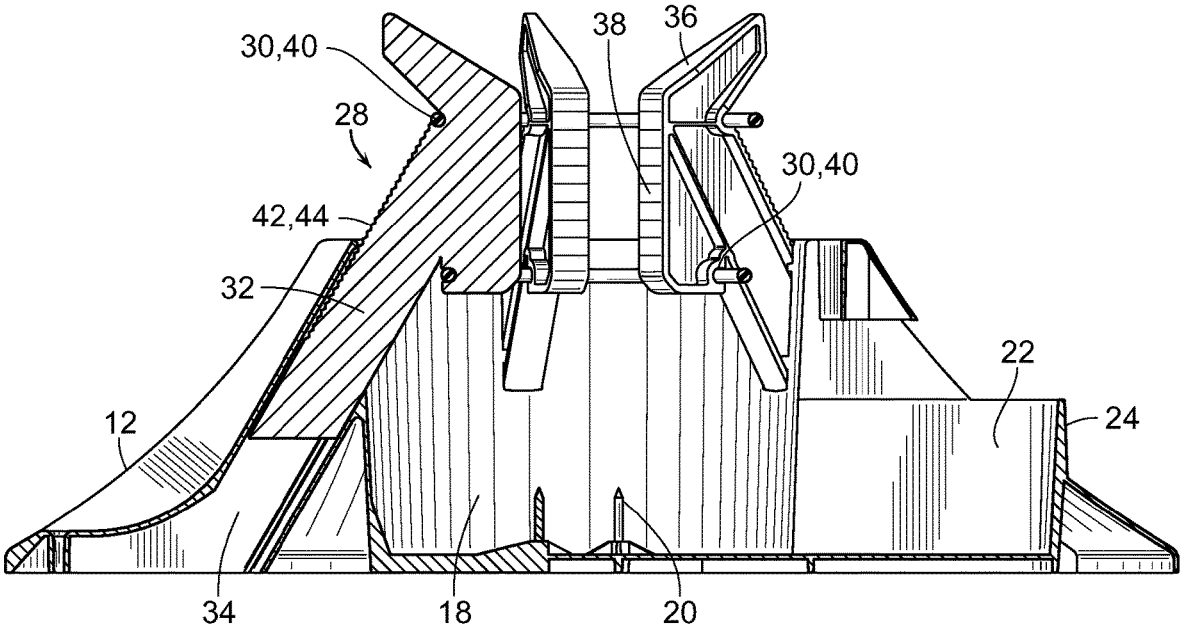
FIG. 5 is a partially sectioned perspective view of the tree stand embodying the present invention in an at rest and a closed clamping state.

With particular reference to FIGS. 4 and 5, in the illustrated, preferred, embodiment, the clamp comprises a plurality of jaws 28 which are arranged in a generally circular pattern so as to substantially encircle a trunk 4 of a tree 2 as the trunk 4 is inserted into the clamp. In the illustrations, there are five jaws 28 generally equally spaced apart from one another, although it will be realized that there could be fewer or more jaws. There should be a sufficient number of jaws so as to secure the tree in an upright and stable manner.

The jaws 28 are biased inwardly, and upwardly, so as to be drawn towards one another, such as being directed towards a generally central axis of the water basin 18. Radial inward pressure is applied to the jaws 28 in order to bias them inwardly towards one another. This may be by many means, including leaf springs, coil springs, or the like. However, in a particularly preferred embodiment, as illustrated, one or more tension bands 30 encircle the jaws 28 and bias the jaws towards one another. The tension bands 30 may be comprised of an elastomeric material. The tension bands 30 may be rubber bands, O-rings, bungie cords, or the like. The circular tension bands 30 have an at-rest diameter and draw the jaws 28 towards one another until the circular tension bands 30 are generally at rest with little to no tension being applied to the jaws 28 when the stand 10 is at an at-rest or non-use condition, as illustrated in FIG. 5.

With continuing reference to FIG. 5, the jaws 28 are slidably connected to the base 12. Each jaw 28 comprises a leg 32 extending therefrom that is slidably movable within a track 34 formed in the base 12. The track 34 is formed at an angle so that the jaws 28 are lifted upwardly as they are brought towards one another by the tension bands 30. The track may be formed at an angle of between 35° and 85° with respect to a generally horizontal support surface of the base 12. Preferably, however, the track 34 is formed at an angle of greater than 45°, such as between 45° and 75°, with respect to a generally horizontal support surface of the base 12, such as the perimeter 14 of the base or a supporting surface such as a floor, ground etc. The angle of the track 34, and thus the corresponding angle of the jaw leg 32, is such that a vertical force component is relatively low to allow for easy installation of the tree 2, but the lateral component of force should be relatively great to allow the tree 2 to tip by pushing a jaw 28 down in order to remove the tree 2, such as at the end of the Christmas season. The angle of the track 34 and jaw leg 32 as illustrated is approximately 60° which, given the size of the jaws 28, enables tree trunk diameters between 2.5 inches to 5.5 inches, or trees approximately four feet to ten feet tall to be supported by the stand 10. Such an angle, or an angle within the preferred range of 45° to 75° enables an individual to relatively easily insert the trunk 4 of a tree 2 of a typical size range offered at a tree lot into the stand 10 without assistance. Moreover, pressing down on as few as a single jaw 28, such as by pressing downwardly with the user's hand or foot, releases the clamping effect and thus the tree 2 can be removed, such as at the end of the holiday season.

Each of the jaws 28 includes an upper surface defining a ramp 36 which is angled downwardly towards the other jaws 28 and a generally central axis of the water basin 18. The angle of the ramp 36 may be between 5°-85° from vertical or 95°-175° as it relates to the generally horizontal support surface upon which the stand 10 is placed, or in the illustrated embodiment the generally planar and horizontal peripheral bottom edge 14 of the base 12. The ramps 36 direct the tree trunk 4 towards a center of the clamp and water basin 18.

Each jaw 28 also includes a tree trunk outer surface engaging face 38. As illustrated, these faces 38 are generally vertical in orientation and configured to engage an outer circumferential surface 8 of the tree trunk 4 and apply pressure thereto due to the bias of the tension bands 30. The face 38 of the jaws 28 may be serrated or otherwise roughened so as to provide grip between the face 38 of the jaw 28 and the outer surface 8 of the tree trunk 4.

The jaws 28 include one or more hooks 40 or the like for receiving the tension bands 30 therein. In the illustrated embodiment, there are two tension bands 30 used, and thus two hooks or tension band receiving openings 40 spaced apart from one another and generally coinciding with an upper portion and a lower portion of the jaw face 38 which engages the outer surface 8 of the tree trunk 4. In this manner, force is applied generally across the entire jaw face 38 and against the tree trunk 4. It will be understood, however, that there may be only one or more than two tension bands 30 which are used, and thus a corresponding number of hooks 40 or other tension band receiving connections or depressions.

The predominant stress on the jaws 28 in operation is bending, and particularly bending of the jaw legs 32. Accordingly, the jaws are preferably configured to have an I-beam cross-section, which shape and configuration provides superior strength against bending.

Figure 7A:
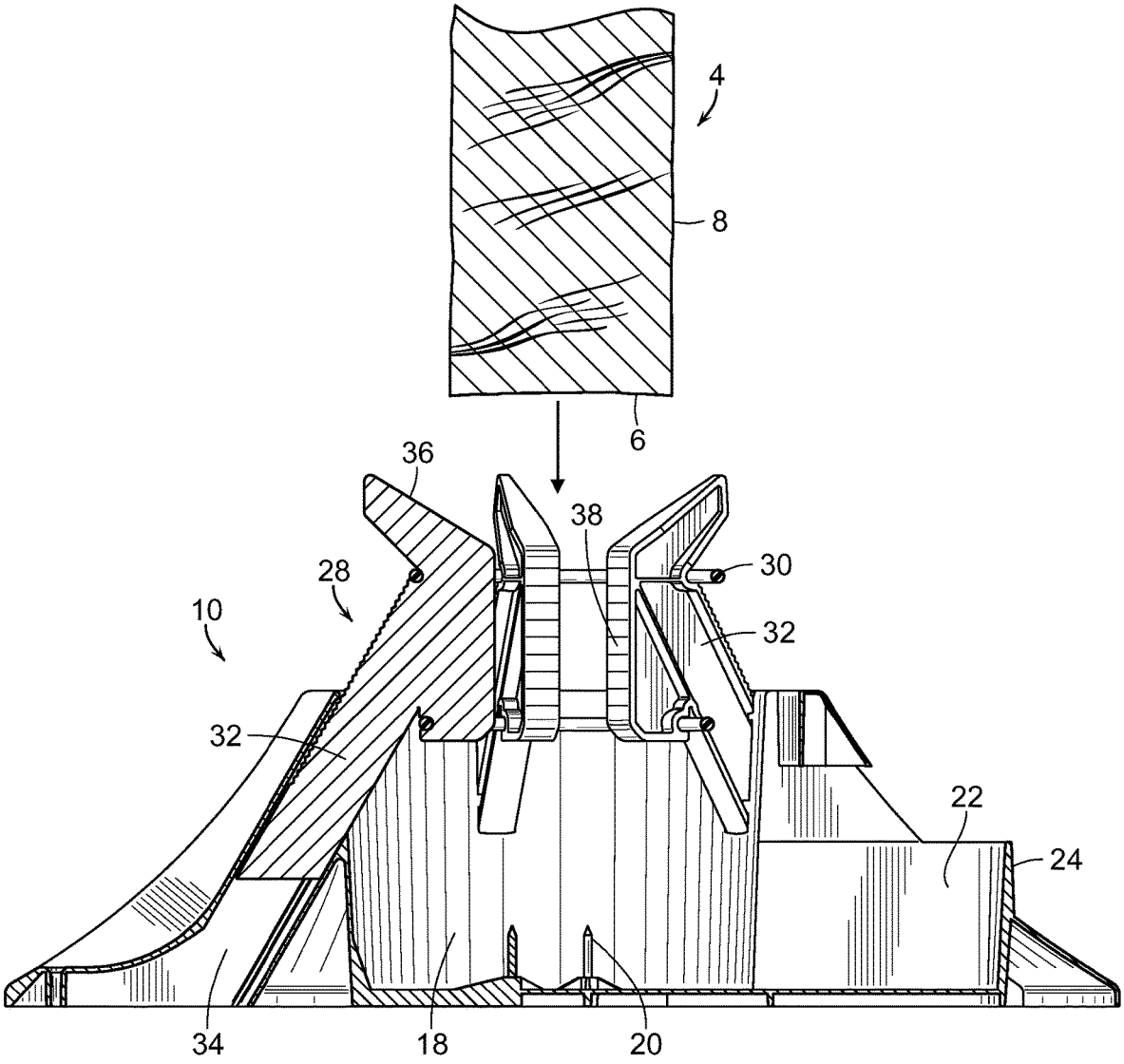
FIGS. 7A-7C are partially sectioned and perspective diagrammatic views illustrating a trunk of a tree being inserted into the stand, in accordance with the present invention.
Figure 7B:
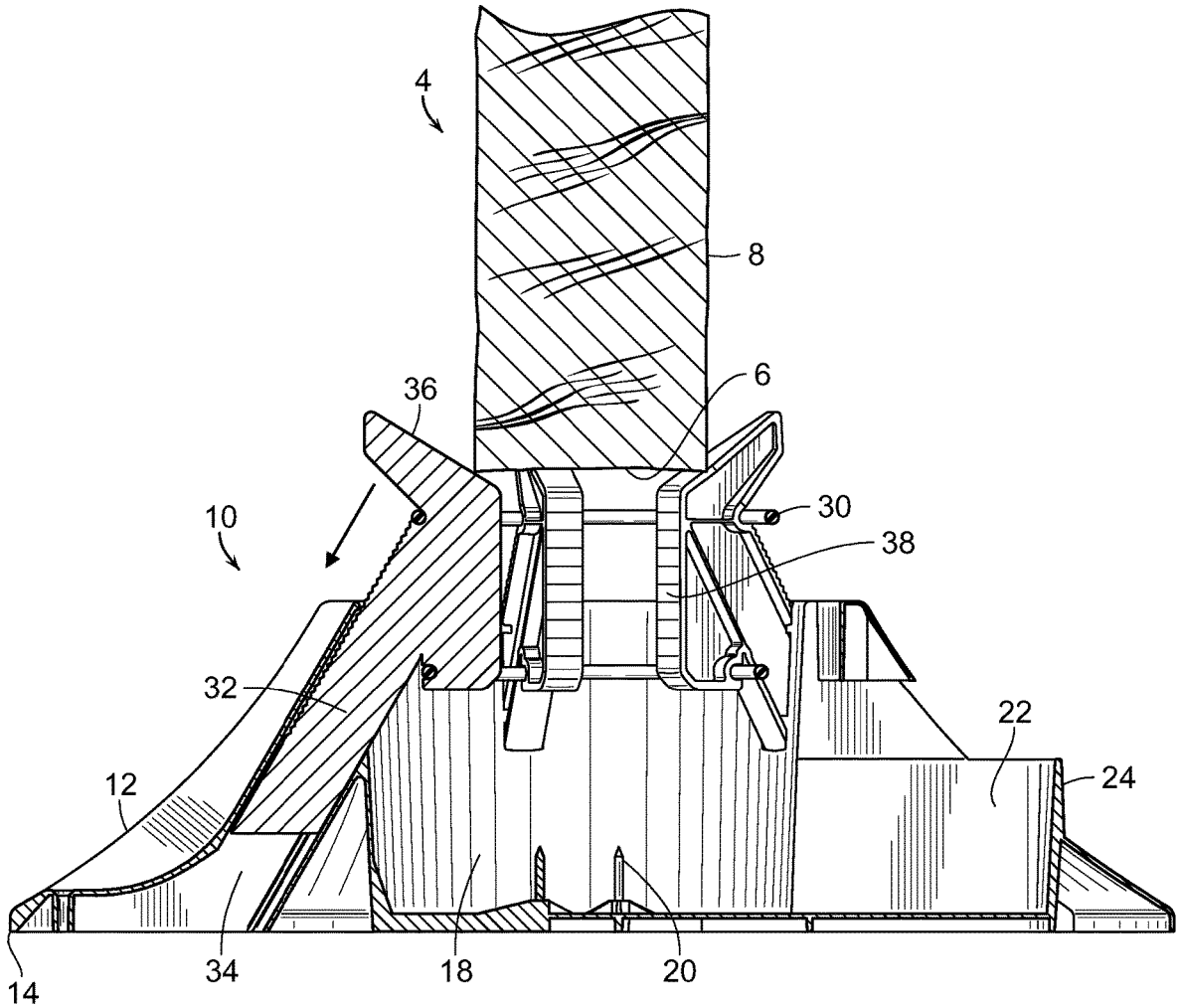
Figure 7C:
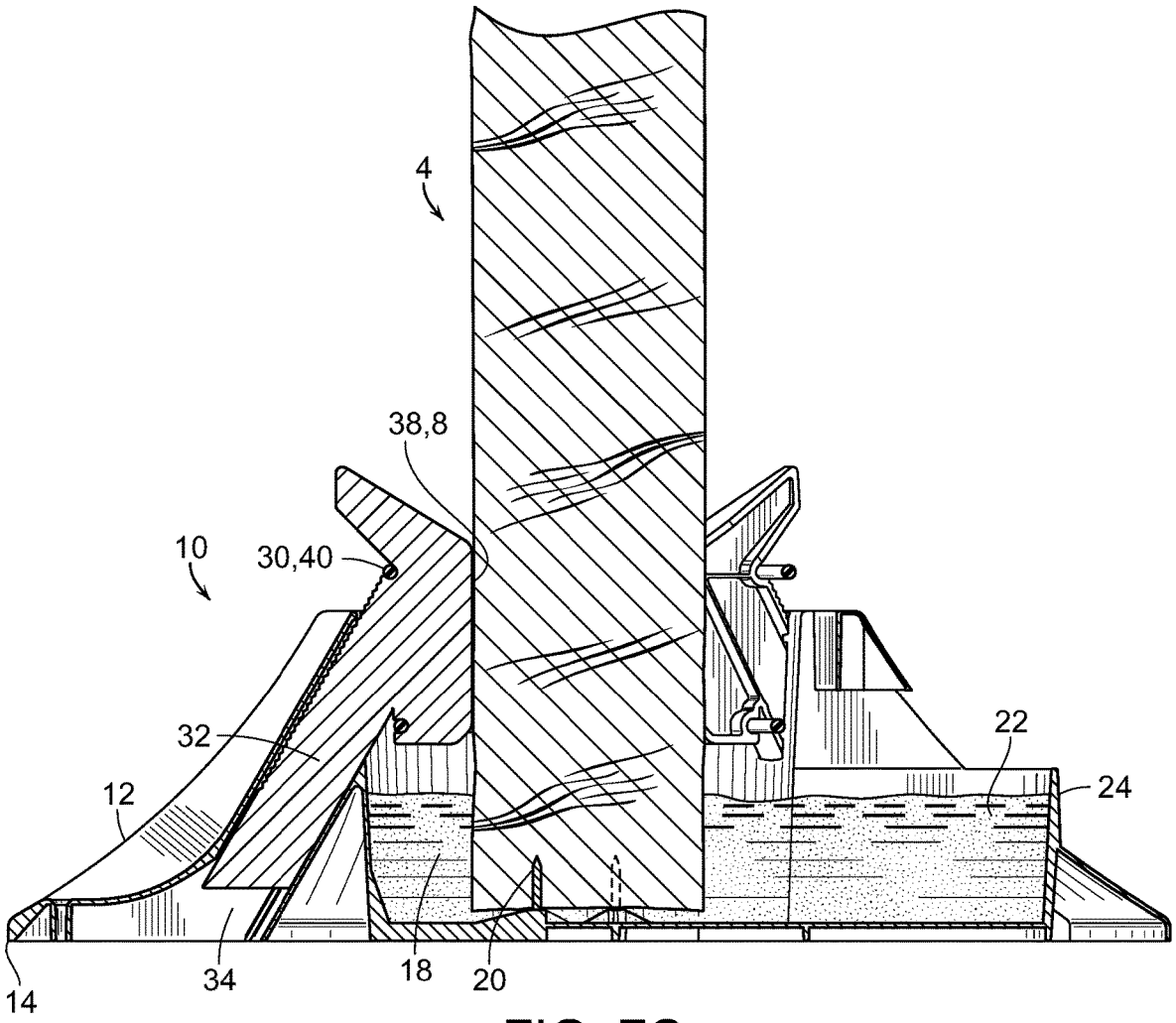

With reference now to FIGS. 7A-7C, in use, the trunk 4 of a Christmas tree 2 is inserted onto the ramps 36 of the jaws 28, the angle of which positions the trunk 4 generally at the center axis of the water basin 18 and stand 10. As the user lowers the tree 2, the weight of the tree exerts a vertical component of force onto the jaw ramp 36. The angled shape of the ramp 36 provides for the minimum to maximum range of tree trunks to slide down and into the clamping faces 38 of the jaws 28. The jaws 28 react to the downward force by sliding down within tracks 34 and thus apart from one another, as illustrated in FIG. 7B. This occurs until the tree trunk is fully inserted within the water basin 18, such as resting upon or being impaled by the one or more spikes 20, which center tree trunk 4 within the water basin 18 and prevent the trunk 4 from sliding on the bottom surface of the water basin 18, as described above. When the tree trunk is fully inserted into the water basin and stand 10, as illustrated in FIG. 7C, the jaw faces 38 engage the outer circumferential surface 8 of the tree trunk 4 and apply pressure thereto as the sliding down and apart of the jaws 28, caused by the downward force of inserting the tree trunk 4 into the stand 10 increased the tension force exerted by the tension bands 30 through the jaws 28 and onto the tree trunk 4. As described above, the tracks 34 are angled such that the horizontal component of force exerted from the tension bands 30 through the jaws 28 is greater than the vertical component. The result is low input force to install or remove the tree 2, but high force is required to allow the tree to tip or fall.

Installation of the tree within the stand 10 is complete after the tree is seated onto one or more spikes 20. In this position, the bottom 6 of the tree trunk is fixed from translation and the tree stand assembly 10 is exerting an axially symmetric force around the outer surface 8 of the tree trunk at each of the faces 38 of the jaws, thus holding the tree upright and secure. Water can then be added to the water basin 18, which will extend into the trough 22, as illustrated in FIG. 7C.

Figure 6:
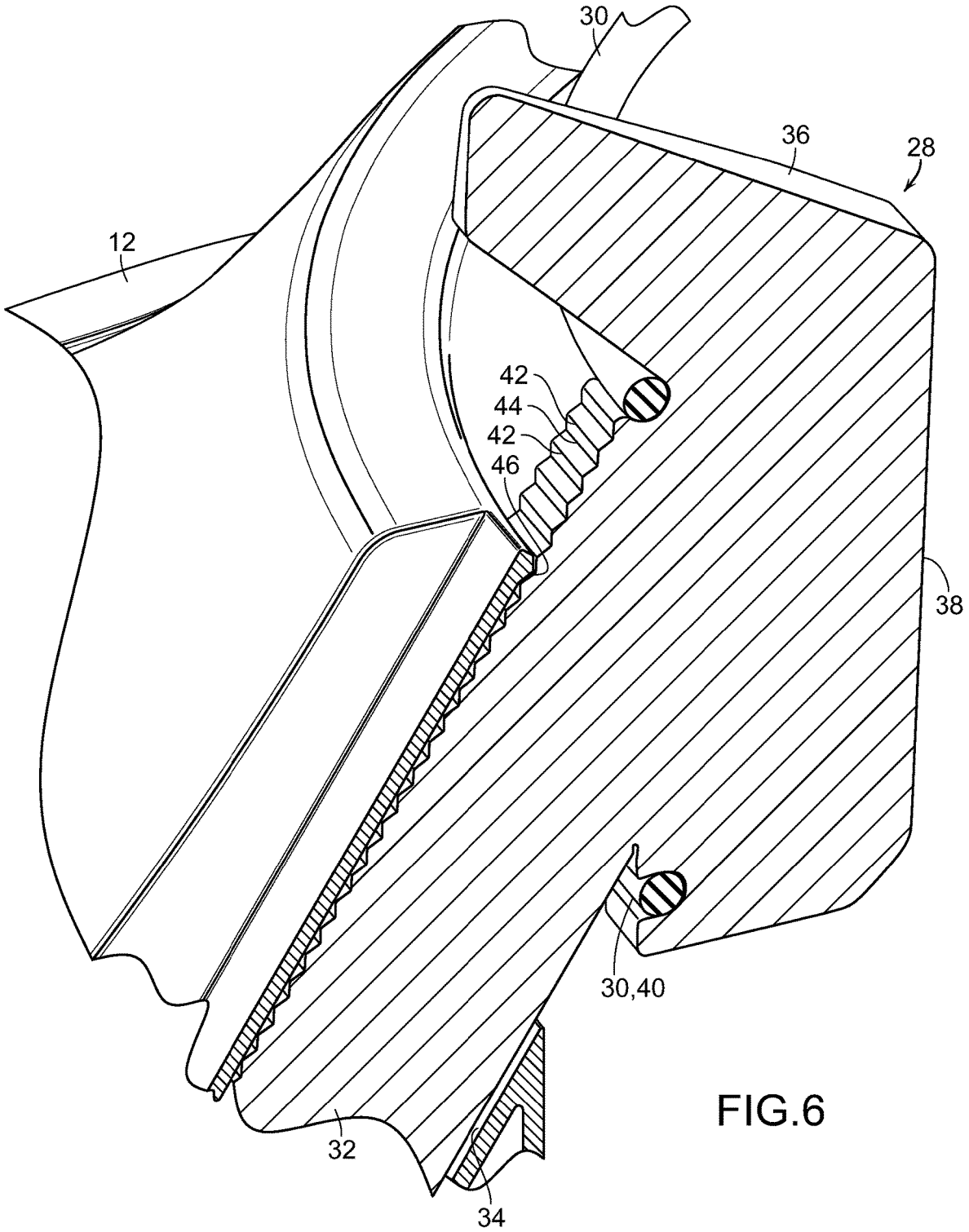
FIG. 6 is a partially sectioned and perspective view illustrating a jaw within a track of the base, in accordance with the present invention.

With reference now to FIGS. 4 and 6, an edge of the jaw leg may be serrated or the like to form a series of ridges 42 with valleys or depressions 44 therebetween. If a jaw 28 experiences an excessive lateral force, such as a lateral force being applied by the tree 2, the jaw leg 32 will move laterally outwardly until a catch 46 formed by the base, typically within the channel 34, engages the ridges 42, such as by becoming inserted into one of the depressions or valleys 44 formed between the ridges 42. This will prevent the jaw 28 from sliding downwardly and thus prevent the tree 2 from tipping over. However, it should be understood that without such a lateral force being applied to the jaw 28, the leg 32 of the jaw 28, and thus the jaw 28 is able to freely slide within the track or slot 34 of the base 12.

Although several embodiments have been described in detail for purposes of illustration, various modifications may be made without departing from the scope and spirit of the invention. Accordingly, the invention is not to be limited, except as by the appended claims.

What is claimed is:

1. A tree stand for removably supporting a tree, comprising:

a water basin;

a base associated with or defining the water basin, the base comprising a side wall extending between a lower end of the base defining a support surface engaging perimeter and an upper end of the base defining a tree trunk receiving opening;

a track associated with the wall of the base so as to extend substantially between the upper and lower ends of the base at an oblique angle with respect to a support surface of the base; and an expandable clamp associated with the water basin and biased towards a closed position, the clamp comprising a plurality of spaced apart jaws slidably engaged with the track so as to move upwardly within the track and towards each other when biased into the closed position;

wherein an end of a trunk of a tree forcibly expands the clamp against its bias so that the jaws move downwardly within the track and away from each other as the trunk is inserted into the water basin, and the jaws engaging an outer surface of the trunk to hold the tree upright with respect to the water basin.

2. The tree stand of claim 1, wherein the base is of a generally frustoconical configuration.

3. The tree stand of claim 1, including a trough extending from the water basin outwardly the side wall of the base.

4. The tree stand of claim 3, wherein a bottom wall of the water basin and a bottom wall of the trough are generally coplaner.

5. The tree stand of claim 1, wherein the jaws each comprise a tree trunk outer surface engaging face and an angled ramp at an upper end thereof for engaging an end of the tree trunk.

6. The tree stand of claim 1, including at least one tension band encircling the jaws and biasing the jaws towards one another.

7. The tree stand of claim 6, wherein the tension band comprises an elastomeric material.

8. The tree stand of claim 1, wherein each jaw comprises a leg extending therefrom that is slidably movable within the track of the base.

9. The tree stand of claim 1, wherein the track is formed at an angle of between 35 degrees and 85 degrees with respect to the support surface of the base.

10. The tree stand of claim 1, wherein the track is formed at an angle of between 45 and 75 degrees with respect to the support surface of the base.

11. The tree stand of claim 1, wherein the track includes a catch that engages a ridge of the jaw when lateral force is applied to the jaw to prevent the jaw from sliding in the track.

12. The tree stand of claim 11, wherein a leg of the jaw has a series of spaced apart ridges, the catch engaging the leg between a set of ridges thereof.

13. A tree stand for removably supporting a tree, comprising:

a water basin;

a base associated with or defining the water basin, the base having a generally frustroconical configuration defined by a wall extending between a support surface engaging perimeter at a lower end thereof and a tree trunk receiving opening at a generally opposite upper end thereof;

a track formed in the wall of the base so as to extend substantially between the upper and lower ends of the base at an oblique angle with respect to a support surface of the base;

an expandable clamp associated with the water basin and biased towards a closed position, the clamp comprising a plurality of spaced apart jaws, the jaws each comprising a tree trunk outer surface engaging face and an angled ramp at an upper end thereof and a leg slidably coupled to the track of the base;

at least one tension band encircling the jaws that biases the jaws so as to move the jaws upwardly within the track and towards each other;

wherein an end of a trunk of a tree forcibly moves the jaws against their closed bias so that the jaws move downwardly in the track and away from one another as the trunk is inserted into the water basin, and the jaws engaging an outer surface of the trunk to hold the tree upright with respect to the water basin.

14. The tree stand of claim 13, including a trough extending from the water basin outwardly a side of the base.

15. The tree stand of claim 14, wherein a bottom wall of the water basin and a bottom wall of the trough are generally coplaner.

16. The tree stand of claim 13, wherein the tension band comprises an elastomeric material.

17. The tree stand of claim 13, wherein the track is formed at an angle of between 35 degrees and 85 degrees with respect to a generally horizontal support surface of the base.

18. The tree stand of claim 17, wherein the track is formed at an angle of 45 to 75 degrees with respect to a generally horizontal support surface of the base.

19. The tree stand of claim 17 wherein the track includes a catch that engages a ridge of the jaw when lateral force is applied to the jaw to prevent the jaw leg from sliding in the track.

20. The tree stand of claim 19, wherein a leg of the jaw has a series of spaced apart ridges, the catch engaging the leg between a set of ridges thereof.

* * * * *